US009617674B2

(12) United States Patent
Hong et al.

(10) Patent No.: US 9,617,674 B2
(45) Date of Patent: Apr. 11, 2017

(54) WASHING MACHINE

(75) Inventors: Sangwook Hong, Seoul (KR); Cheolsoo Ko, Seoul (KR); Hyojun Kim, Seoul (KR); Heakyung Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 749 days.

(21) Appl. No.: 13/448,612

(22) Filed: Apr. 17, 2012

(65) Prior Publication Data

US 2012/0260520 A1 Oct. 18, 2012

(30) Foreign Application Priority Data

Apr. 18, 2011 (KR) ..... 10-2011-0035630
Oct. 24, 2011 (KR) ..... 10-2011-0108607

(51) Int. Cl.

| | |
|---|---|
| ***D06F 29/00*** | (2006.01) |
| ***D06F 58/26*** | (2006.01) |
| ***D06F 58/04*** | (2006.01) |
| ***D06F 58/20*** | (2006.01) |
| ***D06F 58/28*** | (2006.01) |
| ***D06F 25/00*** | (2006.01) |
| ***D06F 58/02*** | (2006.01) |

(52) U.S. Cl.

CPC ..... *D06F 29/005* (2013.01); *D06F 25/00* (2013.01); *D06F 58/04* (2013.01); *D06F 58/20* (2013.01); *D06F 58/26* (2013.01); *D06F 58/28* (2013.01); *D06F 58/02* (2013.01); *D06F 2058/2864* (2013.01)

(58) Field of Classification Search

CPC ..... D06F 25/00
USPC ..... 34/596; 68/20
See application file for complete search history.

(56) References Cited

U.S. PATENT DOCUMENTS

| | | | | |
|---|---|---|---|---|
| 4,549,362 | A | 10/1985 | Haried | |
| 6,230,418 | B1 | 5/2001 | Gomulinski | |
| 6,370,798 | B1 | 4/2002 | Gonzalez, Sr. | |
| 6,643,953 | B2 * | 11/2003 | Song et al. | 34/604 |
| 6,966,124 | B2 * | 11/2005 | Ryu | 34/134 |
| 7,062,863 | B2 * | 6/2006 | Chung | 34/596 |
| 8,347,520 | B2 | 1/2013 | Kuwabara | |
| 2004/0112097 | A1 | 6/2004 | Jeong | |
| 2005/0246920 | A1 * | 11/2005 | Yabuuchi et al. | 34/515 |

(Continued)

FOREIGN PATENT DOCUMENTS

| | | | |
|---|---|---|---|
| CN | 1786327 | A | 6/2006 |
| CN | 101016686 | A | 8/2007 |

(Continued)

OTHER PUBLICATIONS

International Search Report issued in Application No. PCT/KR2012/002878 dated Jun. 17, 2013.

(Continued)

*Primary Examiner* — David J Laux
(74) *Attorney, Agent, or Firm* — KED & Associates, LLP

(57) ABSTRACT

A washing machine including a drying function for drying laundry items received therein is provided. The washing machine may include an air circulating device that circulates air through a tub of the washing machine and heats air for re-supply to the tub, and an air discharge device that discharges a portion of moist air from the tub to an outside of the tub.

2 Claims, 9 Drawing Sheets

(56) References Cited

U.S. PATENT DOCUMENTS

| | | | | |
|---|---|---|---|---|
| 2006/0123853 | A1* | 6/2006 | Hong | D06F 25/00 68/19 |
| 2006/0195989 | A1* | 9/2006 | Jeong | 8/158 |
| 2006/0225468 | A1* | 10/2006 | Hong | 68/20 |
| 2007/0033970 | A1* | 2/2007 | Lee et al. | 68/19.2 |
| 2007/0113421 | A1 | 5/2007 | Uhara et al. | |
| 2008/0078209 | A1* | 4/2008 | Kim | D06F 35/00 68/4 |
| 2011/0277513 | A1 | 11/2011 | Oak et al. | |

FOREIGN PATENT DOCUMENTS

| | | | |
|---|---|---|---|
| CN | 101037839 | A | 9/2007 |
| EP | 0 503 586 | A1 | 9/1992 |
| EP | 1925714 | A1 | 5/2008 |
| GB | 699945 | A | 11/1953 |
| JP | 05-133188 | | 5/1993 |
| JP | 09-149996 | | 6/1997 |
| JP | 2000-061197 | | 2/2000 |
| JP | 2004-135753 | A | 5/2004 |
| JP | 2008-055077 | A | 3/2008 |
| JP | 2008-183335 | A | 8/2008 |
| JP | 2009-106566 | | 5/2009 |
| JP | 2010-057818 | A | 3/2010 |
| JP | 2010-082357 | A | 4/2010 |
| KR | 10-2002-0093469 | | 12/2002 |
| KR | 10-2002-0095370 | A | 12/2002 |
| KR | 10-2003-0017756 | A | 3/2003 |
| KR | 10-2004-0063393 | | 7/2004 |
| KR | 10-2005-0114774 | A | 12/2005 |
| KR | 10-0669182 | B1 | 1/2007 |
| KR | 10-2007-0081440 | | 8/2007 |
| KR | 10-2008-0032365 | A | 4/2008 |
| TW | I 412 644 | B | 10/2013 |
| WO | WO 2010/137910 | A2 | 12/2010 |

OTHER PUBLICATIONS

Korean Notice of Allowance issued in Appln No. 10-2013-0067860 dated Jan. 25, 2014.

International Search Report issued in Application No. PCT/KR 2012/002878 dated Jun. 17, 2013.

Koren Notice of Allowance issued in related application No. 10-2011-0035630 dated May 20, 2014.

Korean Notice of Allowance issued in Application No. 10-2011-0035630 dated Apr. 10, 2014.

European Search Report issued in Application No. 12774381.3 dated Mar. 23, 2015.

Chinese Office Action dated Feb. 4, 2015 issued in Application No. 201280010604.3 (with English translation).

Chinese Office Action issued in Application No. 201410155198.0 dated Sep. 6, 2015.

Chinese Office Action issued in Application No. 201280010604.3 dated Sep. 18, 2015.

Chinese Office Action issued in Application No. 201410155196.1 dated Oct. 9, 2013.

U.S. Office Action dated Sep. 30, 2016 issued in U.S. Appl. No. 14/179,223.

U.S. Office Action dated Oct. 3, 2016 issued in U.S. Appl. No. 14/179,240.

U.S. Appl. No. 14/179,223, filed Feb. 12, 2014.

U.S. Appl. No. 14/179,240, filed Feb. 12, 2014.

Chinese Office Action dated Dec. 21, 2016 issued in Application No. 201410155196.1 (with English Translation).

* cited by examiner

[FIG. 11

WASHING MACHINE

CROSS-REFERENCE TO RELATED APPLICATION(S)

This application claims priority under 35 U.S.C. §119 to Korean Application Nos. 10-2011-0035630 filed on Apr. 18, 2011 and 10-2011-0108607 filed on Oct. 24, 2011, whose entire disclosures are hereby incorporated by reference.

BACKGROUND

1. Field

This relates to a washing machine.

2. Background

In general, a washing machine removes dirt from laundry items using friction force of water flow, and/or impact to laundry caused by rotation of a pulsator or a drum. A full automatic washing machine may perform washing, rinsing, and spinning automatically even without user manipulation during operation of the washing machine. A washing machine may also include a drying function may also dry the laundry after spinning using, for example, a circulating type drying system or an exhaust type drying system.

In a circulating type drying system, air discharged from a tub is condensed, heated, and supplied through an inside of the tub again to circulate the air. In an exhaust type drying system, air outside of the tub is heated and supplied to the inside of the tub, and air inside of the tub is exhausted to an outside of the tub. The exhaust type drying system may consume much energy and time for heating the air if the air outside of the tub has a low temperature. In the circulating type drying system, a large quantity of cooling water may be required for condensing the air.

BRIEF DESCRIPTION OF THE DRAWINGS

The embodiments will be described in detail with reference to the following drawings in which like reference numerals refer to like elements wherein.

DETAILED DESCRIPTION

Figure 1:
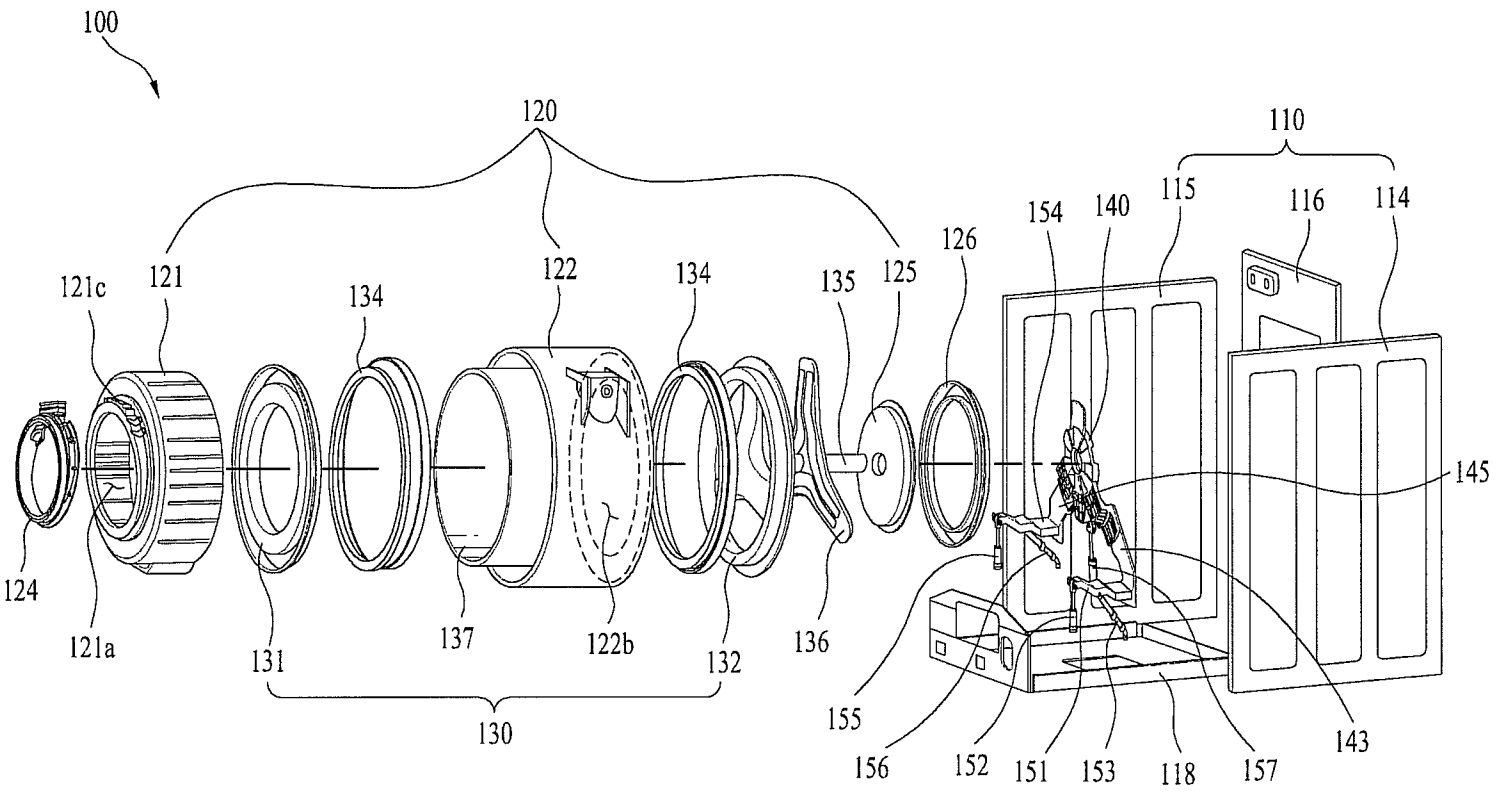
FIG. 1 is an exploded perspective view of a washing machine in accordance with an embodiment as broadly described herein.
Figure 2:
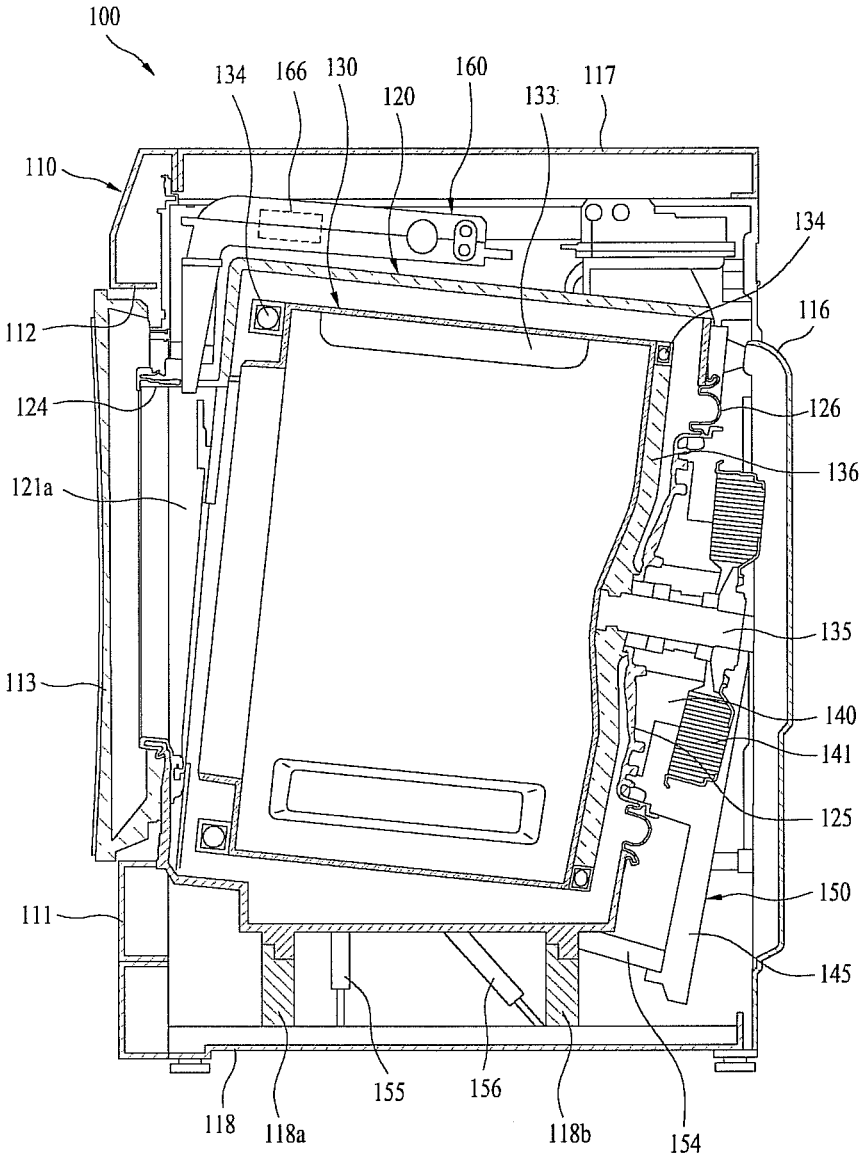
FIG. 2 is a side sectional view of a washing machine in accordance with an embodiment as broadly described herein.

Referring to FIGS. 1 and 2, washing machine 100 in accordance with an embodiment as broadly described herein may include a cabinet 110 which forms an exterior of the washing machine 100, a tub 120 fixed to an inside of the cabinet 110, a drum 130 rotatably provided in the tub 120, a rotation shaft 135 connected to the drum 130 and passing through a rear of the tub 120, a bearing housing 140 which supports the rotation shaft 135, a driving motor 141 provided at the bearing housing 140 for transmission of rotation force to the rotation shaft 135, and a suspension device 150 coupled to the bearing housing 140 for supporting structures connected to the bearing housing 140 and attenuating vibration and impact.

The washing machine 100 may also include an air circulating device 160 fixed to an outside of the tub 120 for heating and supplying air to the inside of the tub 120 during a drying cycle of the washing machine 100.

The cabinet 110 may include a base 118 for supporting and seating various components, a front panel 111 having an opening 112 provided therein for introducing laundry into the drum 130, a left side panel 114, a right side panel 115, a rear panel 116, and a top panel 117. A door 113 may be coupled to the front panel 111 for opening and closing the opening 112.

A water supply device having a water supply hose 127*a* (See FIG. 9) may be provided at, for example, a top inner side of the cabinet 110, for supplying washing water to the inside of the tub 120 from an external source, a water supply valve 127*b* mounted on the water supply hose 127*a* for controlling inflow and outflow of water, and a detergent supply device 127*c* for holding detergent to be introduced into the inside of the tub 120 together with the water being supplied through the water supply hose 127*a*. A drain device having a drain hose 128*a* and a drain pump 128*b* for draining the washing water used during washing and/or rinsing to an outside of the washing machine may be provided at, for example, a bottom inner side of the cabinet 110.

Figure 3:
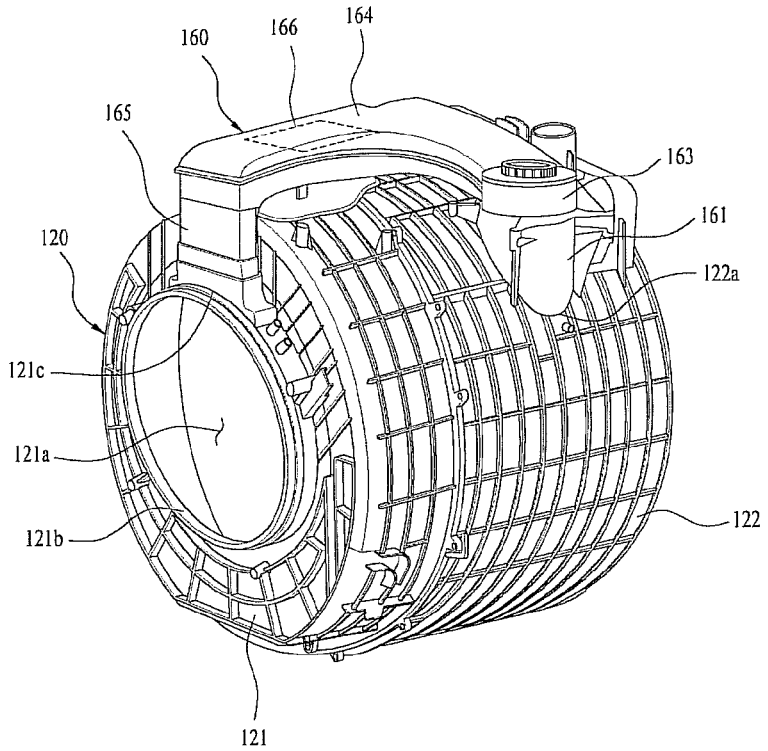
FIG. 3 is a perspective view of an air circulating device coupled to a tub of a washing machine, as embodied and broadly described herein.

Referring to FIG. 3, the tub 120 may include a front tub 121 which forms a front part thereof, and a rear tub 122 which forms a rear part thereof. The front tub 121 and the rear tub 122 may be fastened together with, for example, fasteners, such as, for example, screws or the like, to form a space therein for housing the drum 130. Other attachment methods may also be appropriate.

The front tub 121 may include an introduction opening 121*a* to introduce the laundry into the drum 130 when the door 113 is opened. The introduction opening 121 may include a rim 121*b* projected forward from an inside circumference of the introduction opening 121. The rim 121*b* may include an inlet opening 121*c* to have an air delivery pipe 165 of the air circulating device 160 connected thereto.

A front gasket 124 may maintain air tightness between the opening 112 in the front panel 111 and the tub 120. The front gasket 124 may also prevent foreign matter from infiltrating between the tub 120 and the drum 130.

The rear tub 122 may include a pass through hole 122*b* formed through a rear of the tub 120, a tub back wall 125 and a rear gasket 126. The rear gasket 126 may be positioned between the tub back wall 125 and the pass through hole 122*b* in the rear tub 122 for preventing washing water from leaking from the inside of the tub 120.

When so configured, the tub back wall 125 may vibrate together with the drum 130 as the drum 130 rotates. Therefore, an outside circumferential surface of the tub back wall 125 may be sufficiently spaced apart from the pass through hole 122*b* in the rear tub 122 to prevent the tub back wall 125 from interfering with the rear tub 122 when the drum 130 rotates.

The rear gasket 126 may be formed of a flexible material positioned between the tub back wall 125 and the pass through hole 122*b* in the rear tub 122 so that the tub back wall 125 may move relative to the rear tub 122 without interfering with the rear tub 122. Moreover, the rear gasket 126 may have a corrugated portion extended in an adequate length for allowing the relative movement of the tub back wall 125.

Referring to FIG. 2, the tub 120 may be vertically supported by supporters 118*a* and 118*b* provided at the base 118 of the cabinet 110, as well as fastened with additional fasteners, such as, for example, screws, bolts and the like. In addition to this, the tub 120 may be fastened to the front panel 111 and the rear panel 116, or the left panel 114 and the right panel 115 of the cabinet 110 with fasteners.

Referring to FIG. 1, the drum 130 may include a front drum 131, a center drum 137, and a rear drum 132. Weight balancers 134 may be respectively provided on a rear and a front of the front drum 131 and the rear drum 132 to provide balancing action that attenuates the vibration of the drum 130 when the drum 130 rotates. The center drum 137 may include lifts 133 provided on an inside surface thereof for moving laundry received in the drum 130.

The rear drum 132 may be coupled to a spider 136 connected to the rotation shaft 135 so that the drum 130 is rotated in the tub 120 by rotation force of the rotation shaft 135 transmitted thereto through the spider 136. In this instance, the rotation shaft 135 may be directly connected to the driving motor 141, with a rotor of the driving motor 141 directly connected to the rotation shaft 135 and bearing housing 140 coupled to the rear of the tub back wall 125.

The bearing housing 140 may rotatably support the rotation shaft 135 between the driving motor 141 and the tub back wall 125, and may be elastically supported by the base 118 through the suspension device 150.

The bearing housing 140 may have one side thereof coupled to the tub back wall 125 positioned at the rear of the tub 120, and the rotation shaft 135 may be coupled to the rotor of the driving motor 141 positioned at the other side of the bearing housing 140. The rotation shaft 135 may be supported by bearings provided in the bearing housing 140.

Figure 4:
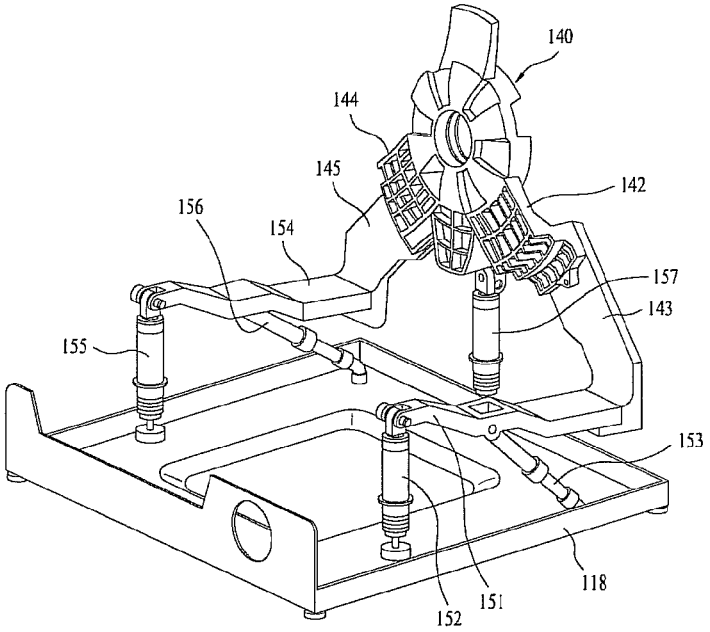
FIG. 4 is a perspective view of a suspension device of a washing machine, as embodied and broadly described herein.

As shown in FIG. 4, the bearing housing 140 may include a first extension 142 and a second extension 144 extending symmetrically and radially outward from a central portion thereof. The first extension 142 and the second extension 144 may have the suspension device 150 fastened respectively thereto, and the bearing housing 140 may be supported elastically by the suspension device 150.

The suspension device 150 may include first and second weights 143 and 145 respectively connected to the first and second extensions 142 and 144 of the bearing housing 140, first and second suspension brackets 151 and 154 respectively connected to the first and second weights 143 and 145, and first, second and third spring dampers 152, 155 and 157, and first and second dampers 153 and 156 connected to the first and second suspension brackets 151 and 154.

The first and second weights 143 and 145 may support a weight center of the drum 130 when the drum 130 has laundry loaded therein, and may also provide mass in a vibration system in which the drum 130 vibrates.

The first spring damper 152 may be connected between the first suspension bracket 151 and the base 118, the second spring damper 155 may be connected between the second suspension bracket 154 and the base 118, and the third spring damper 157 may be directly connected between the bearing housing 140 and the base 118. Therefore, the bearing housing 140 may be attenuated and supported by the spring dampers 152, 155 and 157 at one position to the rear of the bearing housing 140, and at two positions in front of the bearing housing 140.

The first damper 153 may be installed at an incline between the first suspension bracket 151 and a rear portion of the base 118, and the second damper 156 may be installed at an incline between the second suspension bracket 154 and the rear portion of the base 118.

In certain embodiments, the first and second weights 143 and 145, the first and second suspension brackets 151 and 154, the first and second spring dampers 152 and 155, and the first and the second dampers 153 and 156 may be symmetrically arranged with respect to left/right sides of the rotation shaft 135 of the drum 130, i.e., symmetrically arranged with respect to opposite sides of the axis of rotation of the drum 130. The dampers may be respectively connected to the base 118 with additional rubber bushings disposed therebetween so as to be coupled at a predetermined tilt angle between the first and second suspension brackets 151 and 154 and the base 118. In this manner, the drum 130 and the bearing housing 140 may be supported by the first and second suspension brackets 151 and 154, and the first, second and third spring dampers 152, 155 and 157 so as to be suspended with respect to the tub 120.

The driving motor 141 may be fastened to the rear of the bearing housing 140 and directly connected to the rotation shaft 135. Speed of the driving motor 141 may be controlled by a controller.

In a washing machine as embodied and broadly described herein, the tub may be separated from a vibration system, and thus the washing machine may provide increased/maximized a tub capacity within the same cabinet exterior.

More specifically, in an arrangement in which a tub is secured to an inside of a cabinet with springs or dampers, a drum is rotatably provided in the tub, and a driving motor is provided at a rear of the tub for rotating the drum, vibration caused by the drum or the driving motor as the drum rotates would be transmitted to the tub. In such an arrangement, a predetermined space, or clearance, is required between the tub and the cabinet to allow for movement of the tub and prevent interference between the cabinet and the tub when the tub vibrates.

However, in a washing machine as embodied and broadly described herein, the tub is physically removed/isolated from the vibration system, and thus the need for a specified clearance between the tub and the cabinet is greatly reduced/eliminated. Therefore, tub size may be maximized for a fixed interior cabinet volume, and a washing machine as embodied and broadly described herein may provide maximum tub capacity, i.e., may make the most efficient use of the interior volume of a cabinet having a given volume.

Referring to FIG. 3, the air circulating device 160 may be provided, for example, at the top side of the tub 120 for circulating and heating air in the tub 120 during a drying cycle. That is, the air circulating device 160 may draw air from the tub 120 to an outside of the tub 120, heat the air, and re-supply the heated air to the tub 120.

The air circulating device 160 may include an air collection pipe 161 in communication with the tub 120, an air delivery pipe 165 in communication with the tub 120, a circulating duct 164 connected between the air collection pipe 161 and the air delivery pipe 165, a circulating fan 163 for introducing the air from the inside of the tub 120 to the circulating duct 164 through the air collection pipe 161, and a heater 166 in the circulating duct 164 for heating the air.

Upon putting the circulating fan 163 into operation, the air in the tub 120 moves to the circulating duct 164 through the air collection pipe 161 and is heated by the heater 166, and is then supplied back into the tub 120 through the air delivery pipe 165 for drying the laundry in the drum 130.

The air collection pipe 161 may be coupled to a discharge opening 122*a* that extends through a circumferential wall of the tub 120 to communicate the inside of the tub 120 with the circulating duct 164.

Figure 12:
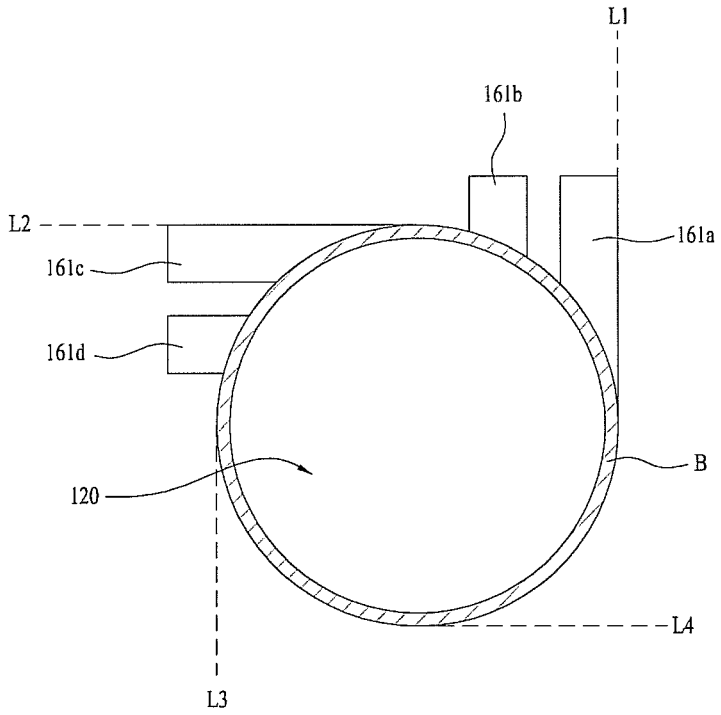
FIG. 12 is a sectional view of a tub body including various orientations of an air collection pipe of a washing machine as embodied and broadly described herein.

As shown in FIG. 12, if the front tub 121 and the rear tub 122 are coupled together to form a cylindrical body B, the air collection pipe 161 may extend in a direction parallel to a tangential line L1, L2, L3 or L4 of the circumferential surface of the body B to allow air to be discharged from the inside of the tub 120 into the air collection pipe 161 easily as the drum 130 rotates. That is, orientation of the air collection pipe 161 may coincide with one of the exemplary tangential lines of the body B, such as the pipe 161*a* which coincides with line L1 or the pipe 161*c* which coincides with L2. Alternatively, the air collection pipe 161 may be parallel to one of the exemplary tangential lines of the body B, such as the pipe 161*b* which is parallel to the lines L1 and L3, or the pipe 161*d* which is parallel to the lines L2 and L4. In certain embodiments, the air collection pipe 161 may be formed as one unit with the circulating duct 164, or with the tub 120.

In an arrangement in which the air delivery pipe 165 is secured to the front gasket 124, the air discharged from the air delivery pipe 165 can only be supplied to the drum 130 after the air is supplied to the tub 120. In contrast, in the washing machine as embodied and broadly described herein, the air delivery pipe 165 may be secured to the inlet opening 121*c* formed in the rim 121*b* of the front tub 121, and air from the circulating duct 164 may be directly supplied to the drum 130, thus improving drying efficiency. This is made possible as the tub 120 is isolated from the vibration system, and thus vibration is not transmitted to the circulating duct 164 through the air delivery pipe 165, even if the air delivery pipe 165 is secured to the inlet opening 121*c* in the rim 121*b*.

The circulating fan 163 may be provided at any position which allows the circulating fan 163 to move the air from the inside of the tub 120 to the circulating duct 164. For example, the circulating fan 163 may be provided in the air collection pipe 161 or inside of the circulating duct 164.

The circulating duct 164 may have one end connected to the air delivery pipe 165, and the other end connected to the air collection pipe 161 for circulating the air in the tub 120. The circulating duct 164 may be fixed to a top side of the tub 120, or other location as appropriate.

The heater or the circulating fan provided in the circulating duct may be damaged by the vibration of the tub in an arrangement in which the circulating duct is fixed to the top side of the tub if the tub is not isolated from the vibration system. In a washing machine as embodied and broadly described herein, such damage may be avoided, as the tub is isolated from the vibration system, even with the circulating duct fixed to the circumferential surface of the tub.

Though in the exemplary embodiment shown in FIG. 3 both the inlet opening 121*c* and the discharge opening 122*a* are provided at the top side of the tub 120, the inlet opening 121*c* and the discharge opening 122*a* may be provided at other locations, such as, for example, a lower side of the tub 120.

It is understood that the cabinet 110 provides a limited, predetermined interior space, with various components of the washing machine positioned therein. Therefore, if it is intended to increase a capacity of the tub 120, without increasing an overall volume of the cabinet 110 and the space occupied by the cabinet 110 in a room in which it is installed, a space between the tub 120 and the cabinet 110 may be reduced and tub capacity increased by eliminating interference between the tub 120 and the cabinet 110 and elements in the cabinet 110.

In an arrangement in which the air circulating device can not be arranged only on the top side or the lower side of the tub in a straight line due to a required length thereof, but rather in a form of surrounding the tub (for example, such that the heating duct is positioned on the top side of the tub, and the condensing duct is positioned on a rear side of the tub to provide for communication between the heating duct and the tub), it is difficult to increase tub capacity (volume) due to the interior cabinet space occupied by these components. Efficiency of such an arrangement may be further impacted by flow resistance acting on the circulating air caused by the long length.

However, since the air circulating device 160 of the washing machine as embodied and broadly described herein does not include a condensing duct, as the tub functions as the condensing duct, the air circulating device may be positioned only on the top side or only on the lower side of the tub. This may allow tub capacity to be increased, and also reduce flow resistance of the circulating air.

The washing machine 100 as embodied and broadly described herein may also include an air discharge device 180 for improving drying efficiency during a drying cycle.

Referring to FIGS. 5 to 11, the air discharge device 180 may be provided in a variety of forms, and may be provided at the tub 120 or the air circulating device 160 for discharging a portion of the air to an inside or an outside of the cabinet 110 from an inside of the tub 120.

Figure 5:
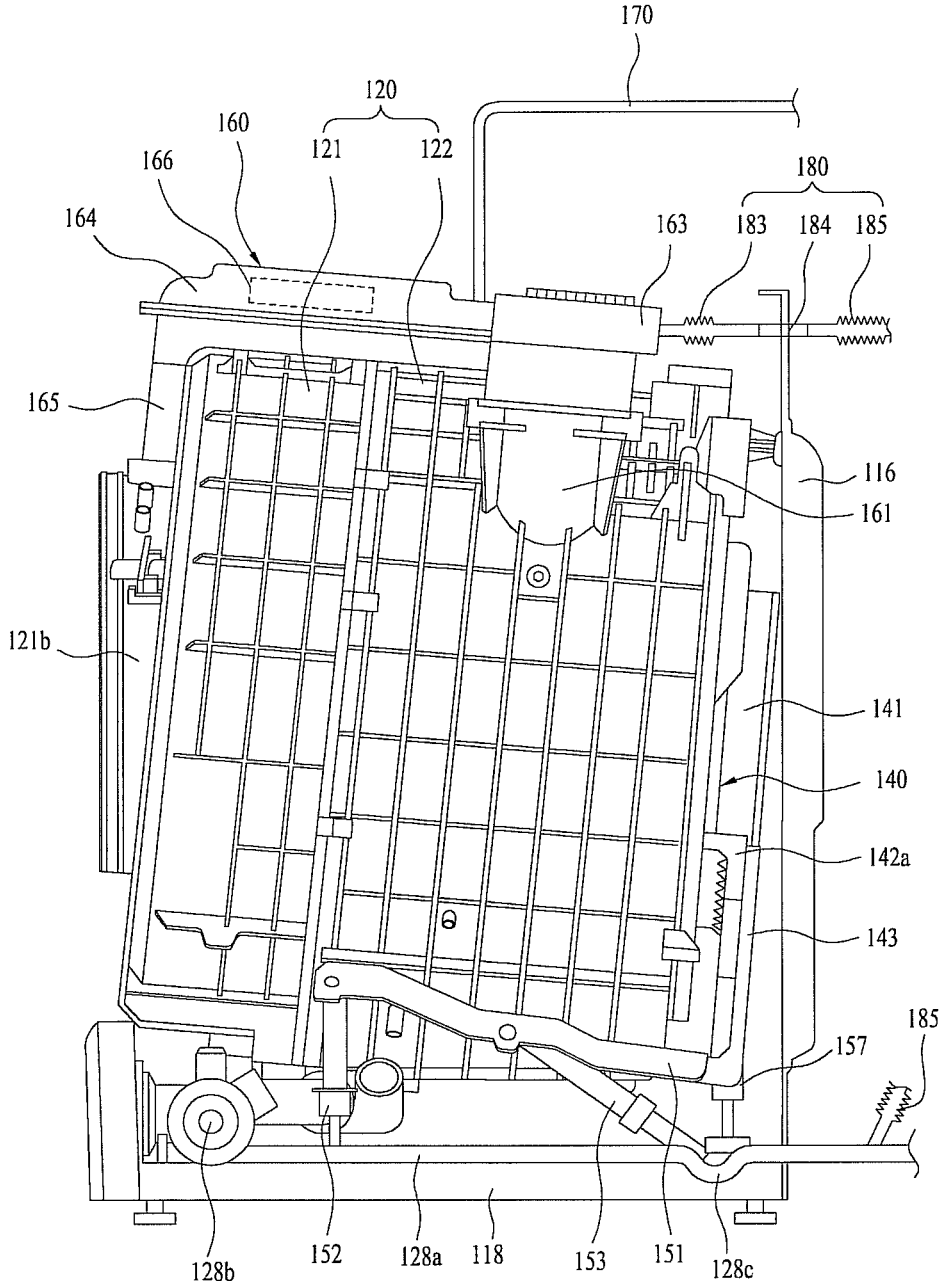
FIG. 5 is a side view of a tub and a suspension device of a washing machine, as embodied and broadly described herein.
Figure 6:
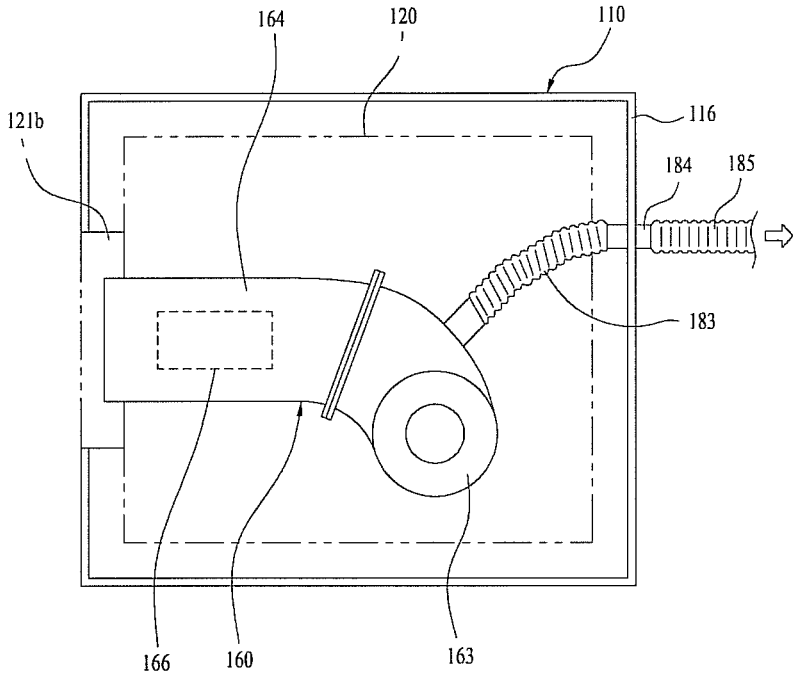
FIG. 6 is a schematic view of an air discharge device of a washing machine, as embodied and broadly described herein.

As shown in FIGS. 5 and 6, the air discharge device 180 may discharge a portion of the air introduced into the air circulating device 160. The air discharge device 180 may include an air exhaust pipe 183 branched from the circulating duct 164 and in communication with an outside of the cabinet 110.

The air exhaust pipe 183 may have one end thereof connected to the circulating duct 164 and the other end thereof passing through the rear panel 116 of the cabinet 110. The rear panel 116 of the cabinet 110 may include a hole formed therein that receives the air exhaust pipe 183 therethrough.

In certain embodiments, the air exhaust pipe 183 may have one end coupled between the circulating fan 163 and the heater 166 such that the air is discharged to the outside of the cabinet 110 from the tub 120 through the air exhaust pipe 183 without a separate air blowing device.

In alternative embodiments, different from FIG. 6, the air exhaust pipe 183 may be coupled to the housing which houses the circulating fan 163, for discharging a portion of the air being discharged from the tub 120 to the outside of the cabinet 110.

The air discharge device 180 may also include a connection member 184 that passes through the cabinet 110, and a discharge pipe 185 connected to the connection member 184. In certain embodiments, the air exhaust pipe 183 may include a vibration attenuation portion for preventing vibration generated by the air circulating device 160 from being transmitted to the rear panel 116 of the cabinet 110 via the air exhaust pipe 183. The vibration attenuation portion may be, for example, a corrugation provided at an outer circumferential surface of the air exhaust pipe 183.

The discharge pipe 185 may discharge (moist) air from the inside of the tub 120 to an outside of the washing machine 100 through the air exhaust pipe 183. However, to prevent odor and moisture contained in the moist air from being discharged in the immediate vicinity of the washing machine and generating an unpleasant environment, the discharge pipe 185 may be connected to the drain hose 128*a* which drains the washing water or the condensed water from the inside of the tub 120. In order to prevent bad odor from flowing in a reverse direction, the drain hose 128*a* may include a "U" type trap 128*c*, with the discharge pipe 185 connected to a rear end of the trap 128*c*.

The operation of a washing machine in accordance with embodiments will now be described.

Upon initiating a drying cycle, the circulating fan 163 of the air circulating device 160 is put into operation to draw the air from the inside of the tub 120 into the circulating duct 164 through the air collection pipe 161. The air is heated by the heater 166 in the circulating duct 164, and supplied back to the inside of the tub 120 through the air delivery pipe 165.

The heated air supplied to the inside of the tub 120 undergoes heat exchange with the laundry in the drum 130/tub 120 and absorbs moisture from the laundry. A portion of the moist air in the tub 120 circulates along the circulating duct 164 by the circulating fan 163, and the remaining portion of the moist air in the tub 120 is discharged to the outside of the washing machine through the air exhaust pipe 183 and the discharge pipe 185. Since a portion of the moist air is discharged, relative humidity of the remaining circulating air may be more quickly reduced and returned to the tub 120 for drying the laundry without separate air condensing means.

Figure 7:
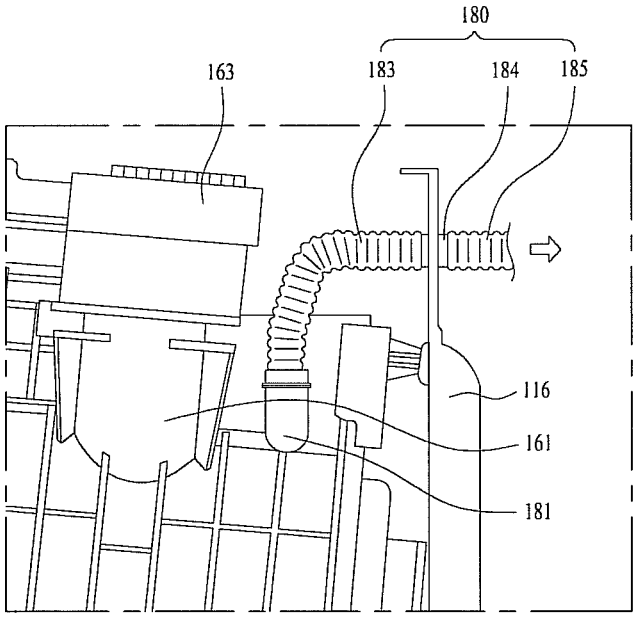
FIG. 7 is a schematic view of an air discharge device of a washing machine in accordance with another embodiment as broadly described herein.

FIG. 7 illustrates an air discharge device of a washing machine in accordance with another embodiment as broadly described herein. The air discharge device 180 shown in FIG. 7 may include a discharge duct 181 for discharging the air from the inside of the tub 120, an air exhaust pipe 183 connected to a connection member 184, and a discharge pipe 185 connected to the connection member 184 for discharging air from the air exhaust pipe 183 to the outside of the washing machine.

The discharge duct 181 may be formed as, for example, a pipe passing through an outer circumferential surface of the tub 120. The discharge duct 181 may be spaced apart a predetermined distance from the air collection pipe 161 in the air circulating device 160. Such an arrangement allows for discharge of a portion of the air that has undergone heat exchange with the laundry to the outside of the washing machine 100 before the air is collected in the air collection pipe 161.

The discharge pipe 185 may be connected to the drain hose 128*a* which drains the washing water from the inside of the tub 120 during washing or rinsing. In this case, the discharge pipe 185 may be connected to a rear end of the trap 128*c* provided in the drain hose 128*a*.

Since the circulating fan 163 comes into operation when the washing machine 100 initiates the drying cycle, the air is drawn from the inside of the tub 120 into the circulating duct 164 through the air collection pipe 161 and is heated by the heater 166. The heated air is then supplied back to the tub 120 through the air delivery pipe 165 for heat exchange with the laundry in the drum 130. The air that has undergone heat exchange with the laundry may become moist as it absorbs moisture from the laundry. A portion of the moist air is collected by the air collection pipe 161, and the remainder of the moist air is discharged to the outside of the washing machine 100 through the air discharge device 180.

As air is introduced back in to the tub 120 by the circulating fan 163, a pressure inside of the tub 120 may increase, and thus a portion of the air in the tub 120 may be discharged to the outside of the washing machine through the air discharge device 180.

Therefore, since the washing machine 100 in accordance with this embodiment discharges a portion of the moist air from the inside of the tub 120 to the outside of the washing machine, the humidity level of the moist air collected in the circulating duct 164 may be decreased and laundry may be dried without separate condensing means.

Figure 8:
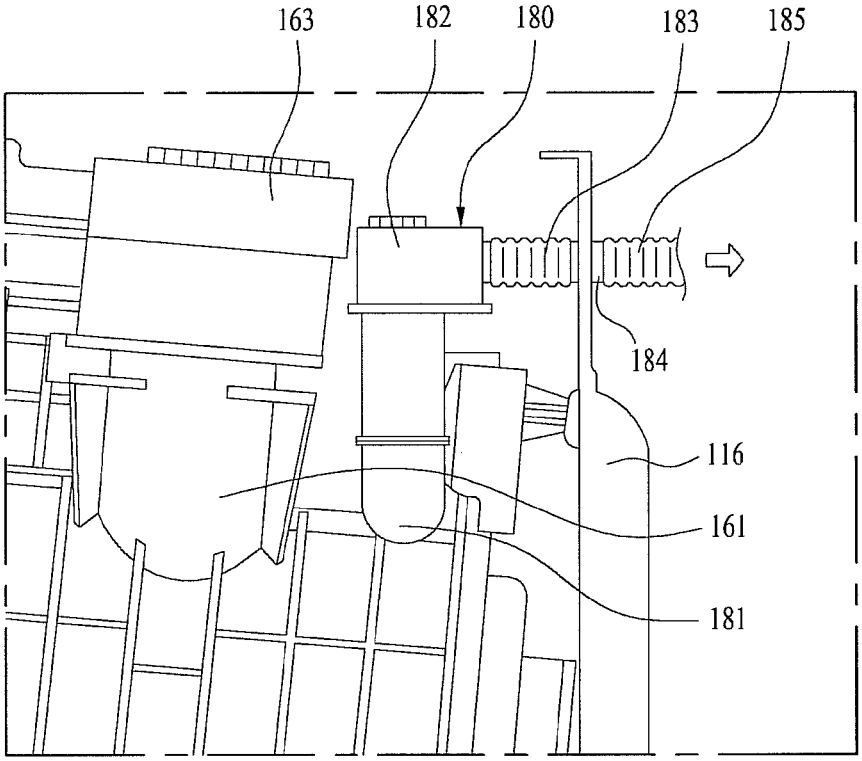
FIG. 8 is a schematic view of an air discharge device of a washing machine in accordance with another embodiment as broadly described herein.

FIG. 8 illustrates a schematic view of a washing machine in accordance with another embodiment, in which an air exhaust fan 182 is provided with the discharge duct 181.

That is, the air discharge device 180 shown in FIG. 8 may include a discharge duct 181 for discharging air from the inside of the tub 120, an air exhaust pipe 183 having one end connected to the discharge duct 181 and the other end connected to the connection member 184, a discharge pipe 185 connected to the connection member 184 for discharging the air from the air exhaust pipe 183 to the outside of the washing machine, and an exhaust fan 182 that draws air through the discharge duct 181 from the inside of the tub 120 and supplies the air to the exhaust pipe 183. Operation of the exhaust fan 182 to facilitate discharge of a portion of the air to the outside of the washing machine 100 also facilitates decreasing a humidity level of the air circulating through the circulating duct 164 more quickly, even without additional air condensing means, thus improving a drying function of the washing machine.

The embodiments described above are based on a case in which no separate condensing devices are provided for cooling down the moist air discharged from the tub and removing moisture from the air (dehumidification). However, in alternative embodiments, an additional condensing device may be provided for further improvement of drying performance.

Figure 9:
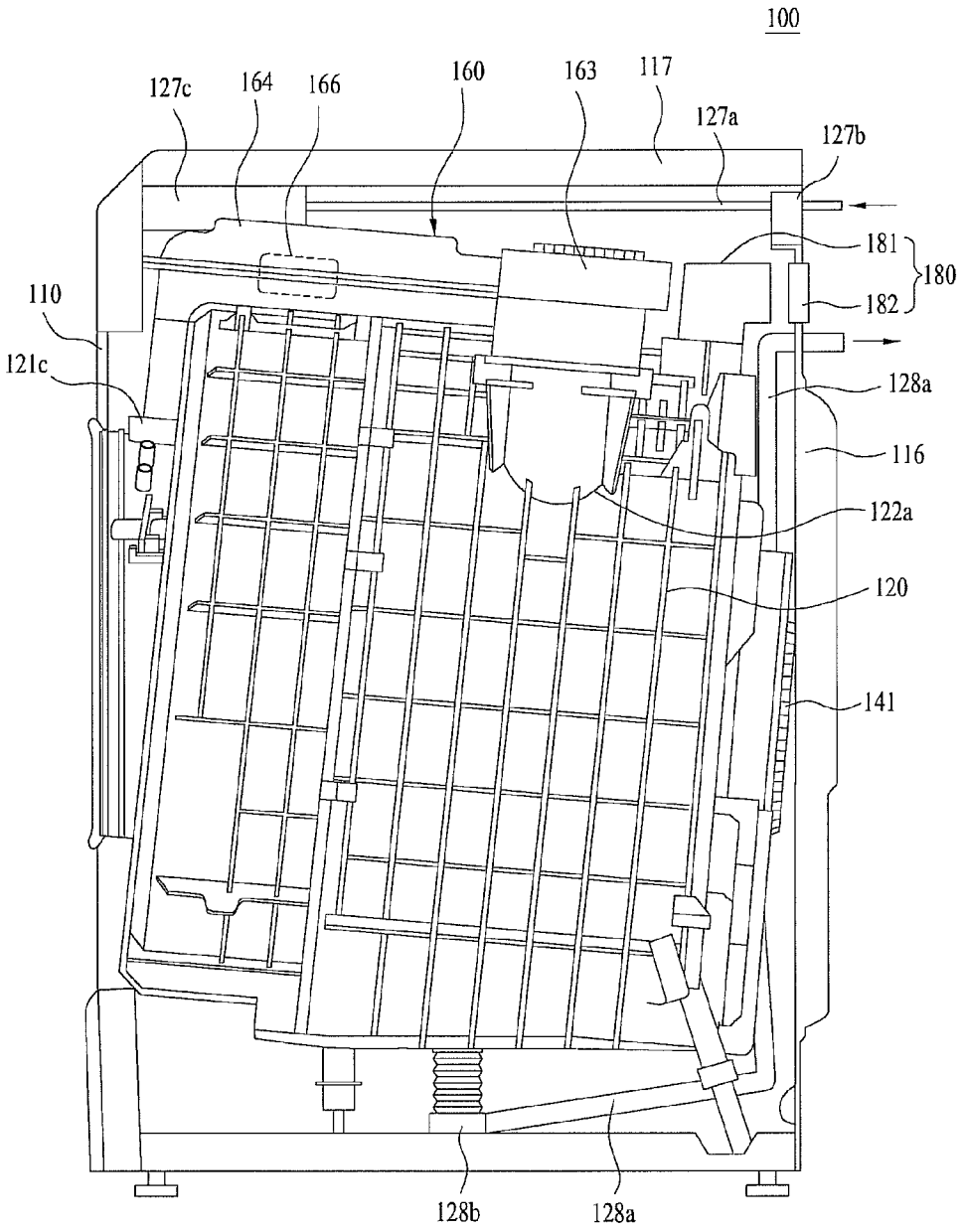
FIG. 9 is a side view of a tub and an air discharge device of a washing machine in accordance with another embodiment as broadly described herein.

FIG. 9 illustrates of a washing machine 100 in accordance with another embodiment, including an air circulating device 160 for heating air being discharged from the tub 120, and supplying the heated air back to the tub 120 again, and an air discharge device 180 for discharging a portion of the air from the tub 120 to the outside of the washing machine 100.

In this embodiment, since the air is heated by the air circulating device 160, time and energy for heating the air and drying the laundry may be reduced, and, since a portion of the air is discharged to the outside of the washing machine 100 through the air discharge device 180, air in the tub 120 may be more easily condensed.

The air discharge device 180 shown in FIG. 9 may include a discharge duct 181 for discharging air from the inside of the tub 120, and an exhaust fan 182 for mixing the air being discharged through the discharge duct 181 with the air inside of the cabinet 110, and discharging the mixed air to the outside of the cabinet 110.

The exhaust fan 182 may be provided at the rear panel 116 of the cabinet 110, with a hole provided in the rear panel 116 for communication between an inside of the cabinet 110 and the outside of the cabinet 110, with the exhaust fan 182 provided in the hole in the rear panel 116.

A first end of the discharge duct 181 may be connected to the outer circumferential surface of the tub 120, and a second end may extend toward the exhaust fan 182, with the discharge duct 181 and the exhaust fan 182 not necessarily physically connected to each other.

In certain embodiments, the second end of the discharge duct 181 may be spaced a predetermined distance from the exhaust fan 182 to allow for mixing of the air being discharged through the discharge duct 181 and the air in the cabinet 110, and then discharging the mixed to the outside of the cabinet 110.

Since the air discharged from the inside of the tub 120 has a relatively high temperature and humidity compared to room temperature air, if only the air from the inside of the tub 120 is discharged to the outside of the cabinet 110 through the discharge duct 181, the air discharged from the discharge duct 181 will be condensed as it meets with the room temperature air outside the washing machine. Therefore, condensation is liable to form on an exterior surface of the washing machine, or in a space in which the washing machine is installed, such as, for example, wall adjacent to the rear panel 116 of the washing machine, if the air discharged from the tub 120 is not first mixed/cooled. If the air is discharged to the outside of the washing machine after mixing with the air in the cabinet 110 as described above, the condensation problem may be mitigated, because a temperature of the air between the tub 120 and the cabinet 110 may be lower than the air in the tub 120, and also close to or lower than room temperature. That is, if the air discharged from the discharge duct 181 is mixed with the air in the cabinet 110, making the temperature of the discharged air close to room temperature, condensation on the wall adjacent to the rear panel 116 of the washing machine may be prevented.

In certain embodiments, a ratio of an amount of air from the inside of the tub 120 to an amount of air in the cabinet 110 included in the mixed air discharged through the exhaust fan 182 may be controlled by controlling a size of the exhaust fan 182 and a driving speed of the exhaust fan 182.

For example, if a ratio of the amount of cabinet air to the amount of tub air in the mixture approximately 5:1 to 7:1, formation of condensation may be minimized, and formation of condensation may be the smallest when the ratio is approximately 6:1. Therefore, the size of the exhaust fan 182, and the driving speed of the exhaust fan 182 may be set such that the ratio of the amount of cabinet air to the amount of tub air is approximately 5:1 to 7:1, and in certain embodiments, 6:1.

A diameter of the discharge duct 181 may also be adjusted, as appropriate.

That is, a flow rate of the air discharged to the outside of the tub 120 by the exhaust fan 182 may be significantly affected by a diameter of the discharge duct 181. Therefore, if a diameter the discharge duct 181 is excessively large and a high flow rate (large volume) of air is exhausted from the inside of the tub, it may be difficult to overcome the disadvantage(s) of the exhaust type drying system. If a diameter of the discharge duct 181 is excessively small and a low flow rate (small volume) of air is exhausted from the inside of the tub, it may be difficult to overcome the disadvantage(s) of the circulating type drying system.

If, for example, 20% to 30% of the air being circulated through the air circulating device 160 is exhausted through the discharge duct during the drying cycle, disadvantage(s) of the circulating type and the exhaust type systems may be overcome in a case in which the above described flow rate of air is exhausted.

In certain embodiments, the ratio may be described in view of a quantity of heat, and the diameter of the discharge duct 181 may be set such that approximately 30 to 40% of the quantity of heat of the air being circulated through the circulating duct 164 is exhausted. In this instance, the quantity of heat may refer to an amount of heat energy required to raise a temperature of a given mass.)

Thus, the diameter of the discharge duct 181 may be set such that 20% to 30% of the air being circulated through the air circulating device 160 is exhausted, or approximately 30 to 40% of the quantity of heat of the air being circulated through the circulating duct 164 is exhausted.

In certain embodiments, the circulating duct 164 and the discharge duct 181 may have temperature sensors or flow sensors respectively provided therein. In this case, the air discharge device 180 discharges a portion of the air from the inside of tub to an outside of the tub so that the temperature of the remaining air in the circulating duct is reduced by 30% to 40%.

It may be possible to determine a flow rate of the air circulating through the circulating duct 164 and a flow rate of the air discharged through the discharge duct 181 with flow sensors provided in the circulating duct 164 and the discharge duct 181 respectively, and to determine the quantity of heat of the air circulating through the circulating duct 164 and the quantity of heat of the air discharged through the discharge duct 181 with the temperature sensors provided to the circulating duct 164 and the discharge duct 181, respectively.

Figure 10:
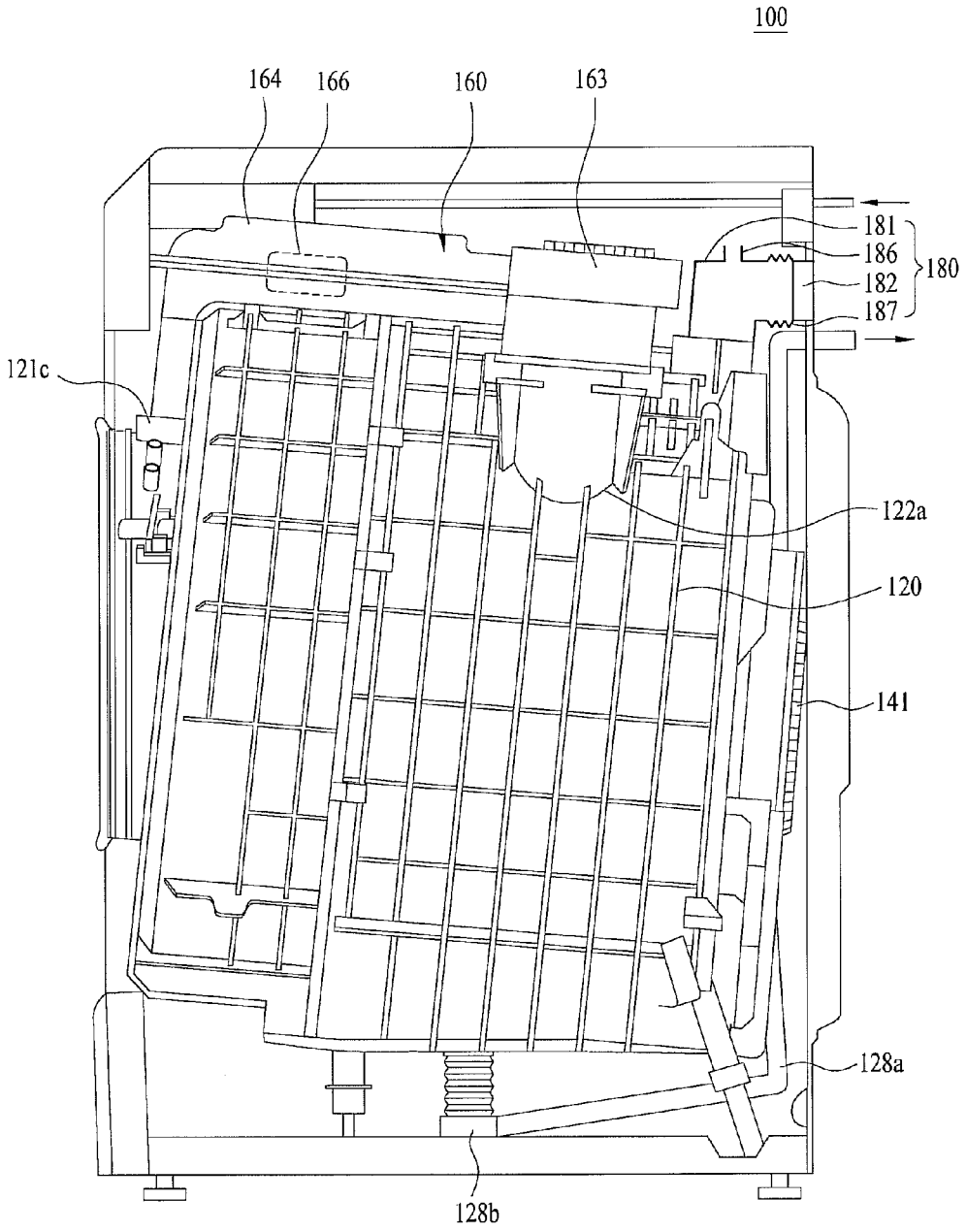
FIG. 10 is a side view of a tub and an air discharge device of a washing machine in accordance with another embodiment as broadly described herein.

FIG. 10 illustrates a washing machine 100 in accordance with another embodiment, including an air discharge device 180 having a discharge duct 181 connected to the rear panel 116 of the cabinet 110. In this embodiment, the air discharge device 180 may include a discharge duct 181 that provides for communication between an inside of the tub 120 and an outside of the cabinet 110, an exhaust fan 182 positioned in the discharge duct 181, and an introduction pipe 186 for introducing the air from the inside of the cabinet 110 into the discharge duct 181. In certain embodiments, the exhaust fan 182 may be provided in a hole formed through the rear panel 116 of the cabinet 110 with one end of the discharge duct 181 connected to the tub 120 and the other end connected to the hole in the rear panel 116. Therefore, when the exhaust fan 182 comes into operation, and air is drawn into the discharge duct 181 from the inside of the cabinet 110 through the introduction pipe 186, the air discharged from the tub 120 will be mixed with the air from the inside of the cabinet 110 before being discharged to an outside of the tub 120.

As shown in FIG. 10, the air discharge device 180 may also include a vibration attenuating device 187 provided, for example, at a connection portion between the discharge duct 181 and the rear panel 116 of the cabinet 110. In this case, the introduction pipe 186 may pass through the discharge duct 181 as shown in FIG. 10, or may pass through the vibration attenuation device 187. The vibration attenuation device 187 may prevent transmission of vibration from the air circulating device 160 to the rear panel 116, and may also prevent separation of the discharge duct 181 from the rear panel 116.

In a washing machine as embodied and broadly described herein, a structure of the tub is isolated from the vibration system. Although a case in which the air circulating device 160 and the air discharge device 180 as embodied and broadly described herein are provided with such a washing machine in which the tub is isolated from the vibration system, technical aspects of the various embodiments are not limited to this. That is, the air circulating device 160 and the air discharge device 180 as embodied and broadly described herein may also be applicable to a washing machine having a structure in which the tub is coupled to the vibration system.

A washing machine having a structure in which the tub is coupled to, or a part of, the vibration system of the washing machine may include a tub fixed to an inside of a cabinet, a drum rotatably provided in the tub, and a driving motor provided at a rear of the tub for rotating the drum. Therefore, upon initiating operation of the driving motor for rotating the drum, the vibration caused by the rotation of the drum and the driving motor is transmitted to the tub. In this case, the vibration attenuation device 187 provided with the air discharge device 180 may prevent vibration of the tub 120 from transmission to the rear panel 116 of the cabinet 110.

In certain embodiments, the vibration attenuation device 187 may be a bellows pipe formed of a flexible material having corrugations formed on an outer circumferential surface thereof. In alternative embodiments, the vibration attenuation device 187 may be the discharge duct 181 itself, formed of a flexible material.

A structure will now be described in which air is discharged from an inside of a tub of a washing machine provided in a building constructed to have built-in domestic appliances.

Figure 11:
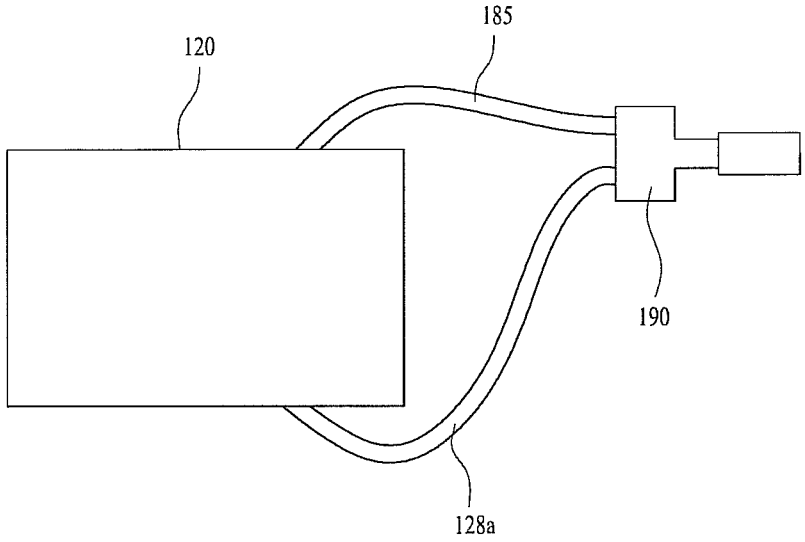
FIG. 11 illustrates of a washing machine in accordance with another embodiment as broadly described herein.

FIG. 11 is a schematic view of a washing machine in accordance with another embodiment, showing only a tub 120, a drain hose 128*a*, a discharge pipe 185, and a coupling member 190 of the washing machine.

In this embodiment, the drain hose 128*a* may drain water from the tub 120, and the coupling member 190 may have the drain hose 128*a* connected thereto. The coupling member 190 may be connected to a pipeline of the building so that water drained from the washing machine may be drained from the drain hose 128*a* and the coupling member 190, and out through the pipeline of the building. The discharge pipe 185 for discharging the air from an inside of the tub 120 to an outside of the washing machine may be connected between the tub 120 and the coupling member 190. Therefore, the air discharged from the tub 120 may be supplied to the coupling member 190 along the discharge pipe 185 and discharged to the pipeline of the building.

The operation of the washing machine having a structure of FIGS. 9 to 11 will now be described.

Upon initiating a drying cycle, the circulating fan 163 and the heater 166 in the air circulating device 160 are put into operation to supply heated air to the drum 130. The heated air supplied to the drum 130 undergoes heat exchange with the laundry to remove moisture from the laundry, and the air containing the moisture absorbed from the laundry moves to the tub 120 from the drum 130. A portion of this moist air circulates through the circulating duct 164, and the remainder of this moist air is discharged to the outside of the cabinet 110 by the discharge duct 181 and the exhaust fan 182.

Since the air introduced into the discharge duct 181 is mixed with the air in the cabinet 110 and discharged to the outside of the cabinet 110 or to the pipeline of the building, formation of condensation on the wall adjacent to the washing machine 100 may be prevented.

Moreover, the washing machine as embodied and broadly described herein may also perform a cooling cycle in which a temperature of the laundry is dropped after completion of the drying cycle.

In this case, a controller may rotate the drum 130 in one direction for cooling down the laundry received in the drum 130 to room temperature after drying is complete. In particular, the controller may rotate the drum 130 at a first speed at which the laundry in the drum 130 does not fall from an inner circumferential surface of the drum 130 by centrifugal force. For an example, the first speed may be set to be approximately 60 RPM to 110 RPM. The air may be exhausted to an outside of the drum 130 through the discharge duct 181 by rotating the drum 130, thus cooling the laundry in the drum 130 to room temperature. The controller may also accelerate the cooling of the laundry by operating the exhaust fan 182 for a predetermined time period during the cooling cycle.

The tub 120 of the washing machine 100 having the above described structure may provide space for holding washing water during a washing cycle, and such a tub 120 may also function as a condensing duct during a drying cycle.

That is, when the circulating fan 163 rotates during drying, the air is introduced into the circulating duct 164 from the inside of the tub 120 through the air collection pipe 161 and heated by the heater 166. The heated air is re-supplied to the tub 120 through the air delivery pipe 165, and the hot re-supplied air is supplied from the tub 120 to the drum 130 for heat exchange with the laundry received in the drum 130.

The hot air containing the moisture absorbed from the laundry is then discharged to the outside of the tub 120 through the air collection pipe 161 connected between the tub 120 and the circulating duct 164. In this process, an inner circumferential surface of the tub 120 (facing an outer circumferential surface of the drum 130) and a space between the tub 120 and the drum 130 may function as the condensing duct which removes the moisture from the hot moist air.

As an outer circumferential surface of the tub 120 is in contact with external air, and a temperature the inner circumferential surface of the tub 120 and the space between the tub 120 and the drum 130 is lower than an inside temperature of the drum 130, the moist air discharged from the drum 130 is condensed at the inner circumferential surface of the tub 120 as it moves toward the air collection pipe 161, and the condensation accumulated at the inner circumferential surface of the tub 120 is drained to the outside of the tub 120 through the drain hose 128*a*.

In particular, since the tub 120 surrounds the drum 130, the moist air may be cooled and condensed as it encounters the entire inner circumferential surface of the tub 120. In order to enhance condensing efficiency, the drum 130 may be rotated at a predetermined speed during the drying cycle.

Though the above embodiment has been described as a washing machine which condenses the air using the tub, a washing machine in accordance with other embodiments as broadly described herein may include a separate condensing duct to connect the tub to the circulating duct and cooling water supply device to remove moisture from the air flowing in the condensing duct as appropriate.

Since a portion of the air circulating through the air circulating unit 160 is discharged to the outside of the washing machine, an amount of the air circulating through the air circulating device 160 may be gradually reduced.

However, since the tub 120 has an inside space which is not necessarily completely enclosed owing to components such as, for example, the detergent box 127*c*, the amount of air reduced by the discharge through the air discharge device 180 may be supplemented from the outside of the washing machine.

Moreover, in order to provide a sufficient quantity of air circulating the washing machine 100 as embodied and broadly described herein, an air supply pipe 170 (See FIG. 5) may supply a fixed flow rate of air to the inside of the tub 120. A first end of the air supply pipe 170 may be connected to the circulating duct 164 and a second end may be in communication with the inside or the outside of the cabinet 110.

In certain embodiments, the one end of the air supply pipe 170 connected to the air circulating duct 164 may be positioned between the heater 166 and the circulating fan 163 for mixing the moist air in the circulating duct 164 with the air outside of the tub 120, and heating the mixed air with the heater 166.

Since a humidity level of the air outside of the tub is lower than the air in the tub 120, if the air outside of the tub 120 is mixed with the moist air in the circulating duct 164, the humidity of the air flowing along the circulating duct 164 may be further reduced.

A washing machine as embodied and broadly described herein may provide improved drying efficiency by discharging a portion of wet air being discharged from a tub after finishing heat exchange with laundry to an outside of the washing machine.

A washing machine as embodied and broadly described herein, may include a cabinet which forms an exterior of the washing machine, a tub provided in the cabinet for holding washing water, the tub having an introduction opening for introduction of air thereto and a discharge opening for discharging the air therefrom, a drum in the tub for holding laundry, an air circulating unit having a circulating duct with one end connected to the introduction opening and the other end connected to the discharge opening for circulating the air in the tub, and a heater in the circulating duct for heating the air introduced to the circulating duct, and an air discharge unit for discharging a portion of the air from the inside of the tub to an outside of the tub.

The air discharge unit may discharge 20 to 30% of the air circulating along the circulating duct.

The air discharge unit may discharge 30 to 40% of a quantity of heat of the air circulating along the circulating duct.

The air discharge unit may discharge a portion of the air circulating along a circulating flow passage formed by the air discharge unit and the tub to an inside of the cabinet or an outside of the cabinet.

The air circulating unit may also include a circulating fan for introducing the air from the inside of the tub to the circulating duct, and the air discharge unit may be an exhaust pipe having one end in communication with the circulating duct, and the other end in communication with the outside of the cabinet for discharging a portion of the air introduced to the circulating duct to the outside of the cabinet.

The air discharge unit may be an exhaust pipe having one end in communication with the inside of the tub and the other end in communication with the outside of the cabinet.

The air discharge unit may include an exhaust duct provided to the tub for discharging the air from the inside of the tub, an exhaust pipe having one end connected to the exhaust duct and the other end in communication with the outside of the cabinet, and an exhaust fan provided to the exhaust duct for moving the air from the inside of the tub to the exhaust pipe.

The air discharge unit may mix the air in the tub with the air in the cabinet and discharge the air mixed thus to the outside of the cabinet.

In this case, the air discharge unit may include a discharge duct for discharging the air from the inside of the tub to an inside of the cabinet, and an exhaust fan provided in the cabinet for discharging the air from the inside of the cabinet to the outside of the cabinet.

The air discharge unit may also include a vibration attenuation unit connected between the discharge duct and the exhaust fan for preventing vibration from transmitting from the discharge duct to the cabinet, and an introduction pipe provided to pass through the discharge duct for introduction of the air from the inside of the cabinet to the discharge duct.

A size and a rotation speed of the exhaust fan may be set to make a ratio of a flow rate of the air discharged from the inside of the cabinet through the air discharge unit and a flow rate of the air discharged from the tub to be 5:1 to 7:1.

A washing machine in accordance with another embodiment as broadly described herein may include a cabinet which forms an exterior of the washing machine, a tub positioned in the cabinet to include a cylindrical body for holding washing water, an introduction opening for introduction of air to the body, and a discharge opening provided to a circumferential surface of the body for discharging the air from an inside of the body, a drum in the tub for holding laundry, an air collection pipe provided to the discharge opening parallel to a tangential line of the circumferential surface of the body for discharging the air from an inside of the tub, an air circulating unit having a circulating duct with one end connected to the introduction opening and the other end connected to the air collection pipe for circulating the air in the tub, and a heater in the circulating duct for heating the air introduced to the circulating duct, and an air discharge unit for discharging a portion of the air from the inside of the tub to an outside of the tub.

In this case, the air discharge unit may discharge 20 to 30% of the air circulating along the circulating duct.

The air discharge unit may discharge a portion of the air circulating along a circulating flow passage formed by the air discharge unit and the tub to an inside of the cabinet or an outside of the cabinet.

The air discharge unit may mix the air in the tub with the air in the cabinet and discharge the air mixed thus to the outside of the cabinet.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing apparatus, comprising:

a cabinet including a rear panel having a through hole extending therethrough;

a tub provided in the cabinet and including:

a circumferential wall, wherein an inner surface of the circumferential wall defines a condensing channel and a condensing space that receives moist air discharged from a drum;

a rim that forms an opening in a front portion of the tub;

an air delivery pipe secured to an inlet opening formed in the rim through which hot air is introduced;

an air collection pipe that protrudes in a tangential direction from a rear portion of an upper side of the circumferential wall of the tub and collects air from the tub; and a discharge duct formed as a pipe that passes through an outer circumferential surface of a rear side of the tub and spaced apart a predetermined distance from the air collection pipe to discharge the air from the inside of the tub, the drum rotatably provided in the tub;

a drying duct connected between the air collection pipe and the air delivery pipe along an upper portion of the tub to form an air movement path for moving and circulating air of the tub from the air collection pipe to the air delivery pipe;

a fan installed between the air collection pipe and the drying duct to move the air, a heater provided in the drying duct that heats the air received from the fan;

a connection member fixed in the through hole formed in the rear panel;

an exhaust pipe having a first end that communicates with the discharge duct and a second end that communicates with an interior of the connection member; and a discharge pipe having a first end that communicates with an exterior of the connection member outside the washing apparatus and a second end that discharges some of the air from the tub to lower a relative humidity in the tub.

2. The washing apparatus of claim 1, wherein the fan is disposed adjacent the air collection pipe upstream of the heater.

* * * * *